United States Patent [19]

Plasschaert et al.

[11] Patent Number: 4,514,781

[45] Date of Patent: Apr. 30, 1985

[54] CORONA DEVICE

[76] Inventors: Paul E. Plasschaert, R.R. #1, Limehouse, Ontario, L0P 1H0; Dolf Landheer, 49 Melrose Ave., Toronto, Ontario, Canada, M5M 1Y6; Harold W. Cobb, 30 Conant St., Acton, Mass. 01720

[21] Appl. No.: 503,007

[22] Filed: Jun. 10, 1983

[30] Foreign Application Priority Data

Feb. 1, 1983 [CA] Canada ..... 420655

[51] Int. Cl.[3] ..... H01T 19/00

[52] U.S. Cl. ..... 361/230; 250/324; 250/325

[58] Field of Search ..... 361/230, 229, 213; 250/324, 325, 326

[56] References Cited

U.S. PATENT DOCUMENTS 3,958,162 5/1976 Kuehnle ..... 361/229

4,056,723 11/1977 Springett et al. ..... 250/324

*Primary Examiner*—Reinhard J. Eisenzopf

*Attorney, Agent, or Firm*—Hirons, Rogers & Scott

[57] ABSTRACT

The invention provides a support member which carries at least one axially aligned corona electrode, and a conductive biasing member wrapped around both the support member and the electrode. The biasing member is preferably a wire wrapped about the support and electrode to form a coil and preferably there are four electrodes. A conductor extends the length of the coil to ensure continuity should the biasing member fail locally.

8 Claims, 5 Drawing Figures

CORONA DEVICE

The present invention relates to a corona device for use in modifying an electrostatic charge on dielectric surfaces, and more particularly to a corona erase device for use in an electrostratic printing apparatus to generate a supply of ions onto a rotating dielectric cylinder surface to cancel any charge remaining on the cylinder surface after a latent electrostatic image has been transferred from the cylinder surface to a copy medium.

Corona devices are used both to place a uniform electrostatic charge on a dielectric surface and to eliminate an existing pattern of charge. Such actions are for the purpose of this description within the scope of the term "modifying an electrostatic charge on a dielectric surface".

The performance of a corona device is reduced by chemical compounds synthesized from the local air environment, which 'grow' on the surface of the electrode. Dielectric toner can also accumulate on the surface of the electrode which produces localised charging and this reduces the magnitude and the consistency of the corona current. These effects can substantially shorten the useful life of the corona electrode thereby requiring a relatively frequent replacement of the entire corona assembly. It is therefore desirable to provide an assembly having more than one corona wire to minimise down time and simplify replacement of a useless wire.

One attempt to provide a multiple corona wire assembly is shown in U.S. Pat. No. 4,056,723 to Springett. This patent teaches a rotatable corona device for use with xerographic reproduction apparatus and having multiple electrodes mounted on a rotatable cylinder. Each electrode has a conductive biasing member associated with it to control the magnitude and polarity of charge deposited on the surface of the cylinder and the device is rotatable so that any one of the electrodes can be located at a desired operational position adjacent the surface onto which charge is to be deposited. If one of the electrodes should fail or become inefficient then the device can be manually or automatically moved to the next position. This assembly requires a considerable number of components and is quite complex resulting in relatively high manufacturing costs. In addition, should a conductive biasing member fail then the particular electrode associated with it can no longer be used even if it is still operating satisfactorily. Therefore although this device solves some of the problems associated with single corona electrode devices it has serious limitations due to its cost, and doubtful reliability and efficiency.

Accordingly it is an object of the present invention to provide an improved corona device having multiple corona wires.

In one of its aspects, the invention provides a support member which carries at least one axially aligned corona electrode, and a conductive biasing member wrapped around both the support member and the electrode.

This and other embodiments of the invention will be better understood with reference to the following description taken in combination with the accompanying drawings, in which.

Figure 1:
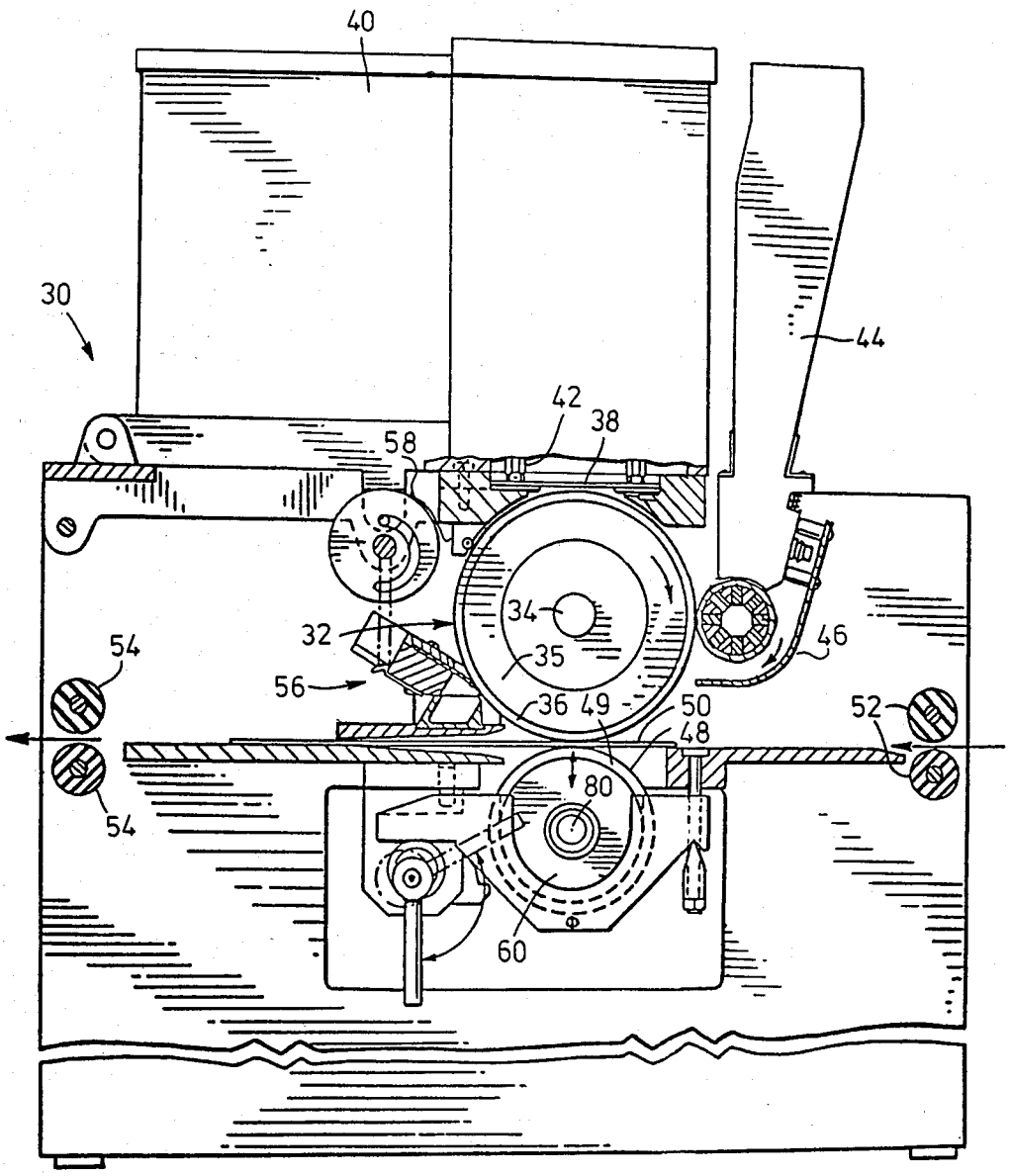
FIG. 1 is a schematic side view, mostly in section, of an exemplary electrostatic printer in which a preferred embodiment of the corona device is mounted for use in erasing a pattern of charge on a dielectric cylinder.

Reference is made first to FIG. 1 which shows somewhat schematically an exemplary electrostatic printer 30 incorporating the invention. This printer is illustrated primarily to demonstrate a suitable environment for the invention. Other printers and also photocopiers using photoreceptors could also benefit from the use of the invention. A cylinder 32 is mounted for rotation about an axis 34 and has an electrically conductive core 35 coated in a dielectric layer 36 capable of receiving an electrostatic image from a cartridge 38 driven by an electronic control system 40 and connected by mechanical connectors 42. As the cylinder rotates in the direction shown, an electrostatic image is formed by the cartridge 38 on the outer surface of the dielectric layer 36 and comes into contact with toner supplied from a hopper 44 by a feeder mechanism 46. The resulting toned image is carried by the cylinder 32 towards a nip formed with a pressure roller 48 having a compliant outer layer 49 positioned in a path of a receptor such as a paper 50 which enters between a pair of feed rollers 52, is driven by the cylinder 32 and roller 48, and leaves between a pair of output rollers 54. The pressure in the nip is sufficient to cause the toner to transfer to the receptor 50 and with sufficient pressure, the toner will be fused to the receptor.

After passing through the nip between the cylinder 32 and the roller 48, any toner remaining on the surface of the dielectric layer 36 is removed by a scraper blade assembly 56, and any residual electrostatic charge remaining on the surface is neutralized by a discharge head 58 positioned between the scraper blade assembly 56 and the cartridge 38.

Figure 2:
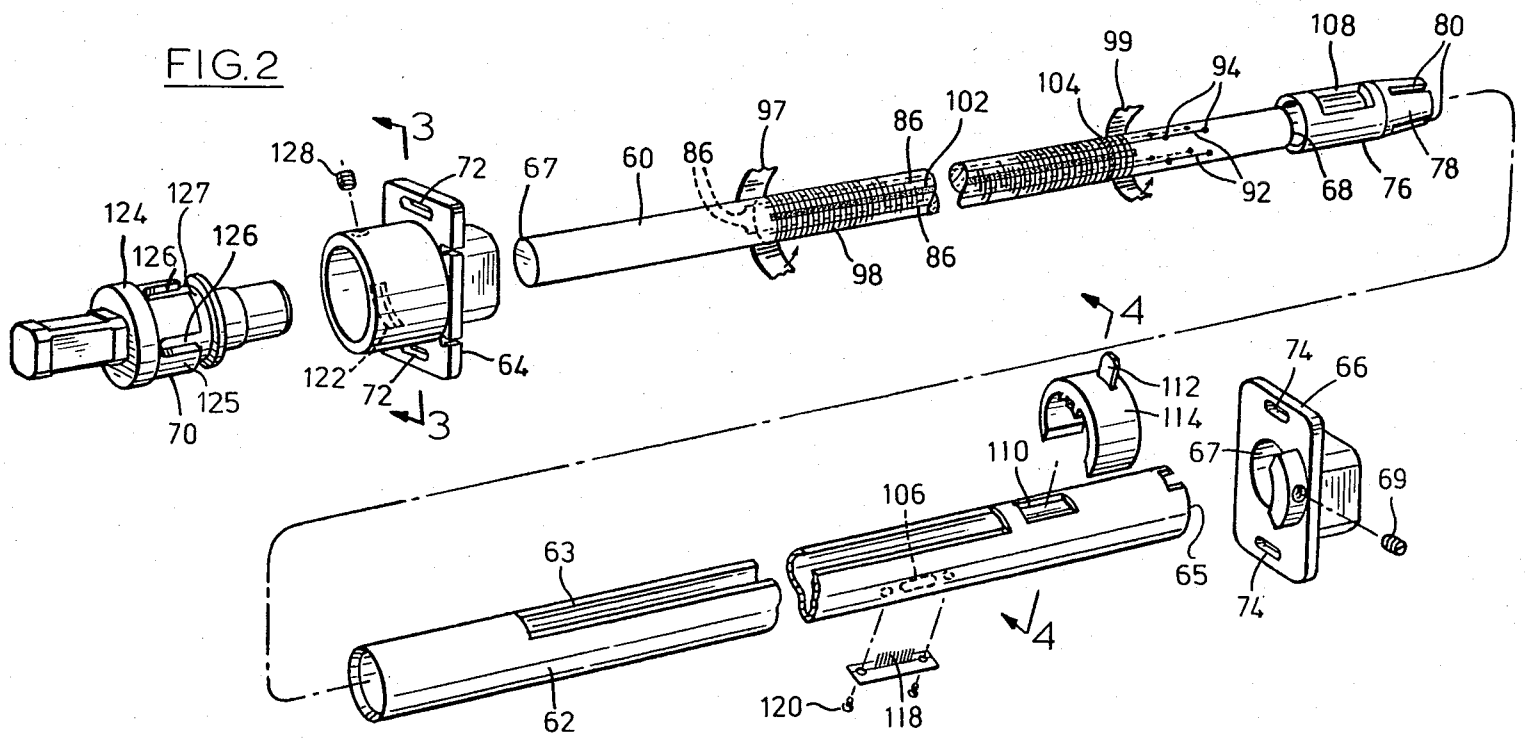
FIG. 2 is an exploded view of the corona erase device illustrating the components and how they are to be assembled.

FIG. 2 shows an exploded view of the components used in the corona erase assembly. A glass rod 60 is located in a brass guide tube 62 having a longitudinal aperture 63 and mounting blocks 64 and 66 are fitted over the ends 67, 68 of the tube respectively. A handle 70 sits in the mounting block 64 and its connection with the glass rod 60 as described in more detail later with reference to FIG. 3. The mounting blocks 64, 66 are adapted to be secured to opposite walls of the electrostatic printer by bolts which pass through respective slots 72, 74 in the mounting blocks.

Figure 4:
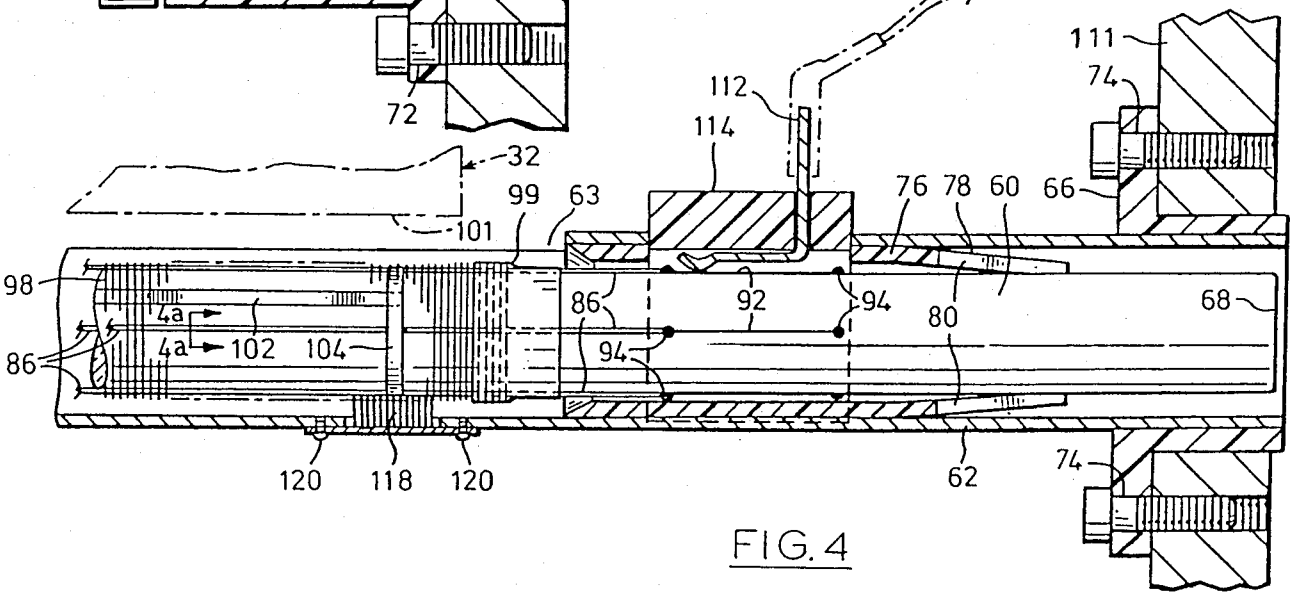
FIG. 4 is a view similar to FIG. 3 but taken on the line 4—4 of FIG. 2 at the opposite end of the corona device when assembled in the electrostatic printer.

The end 68 of the glass rod 60 is centered in the guide tube 62 by a polycarbonate sleeve 76, which, as seen in FIG. 4, has a tapered end 78 with four longitudinal slots 80 spaced equally around its circumference to form fingers. The sleeve is a sliding fit in the guide tube and the diameter of the glass rod is slightly greater than that of the inner end of the sleeve 76 so that when the glass rod extends through the sleeve the fingers are deflected. Also, due to the resilience of the polycarbonate, reaction forces are created which cause the fingers to retain the glass tube 60 securely centered in the tube guide.

Figure 3:
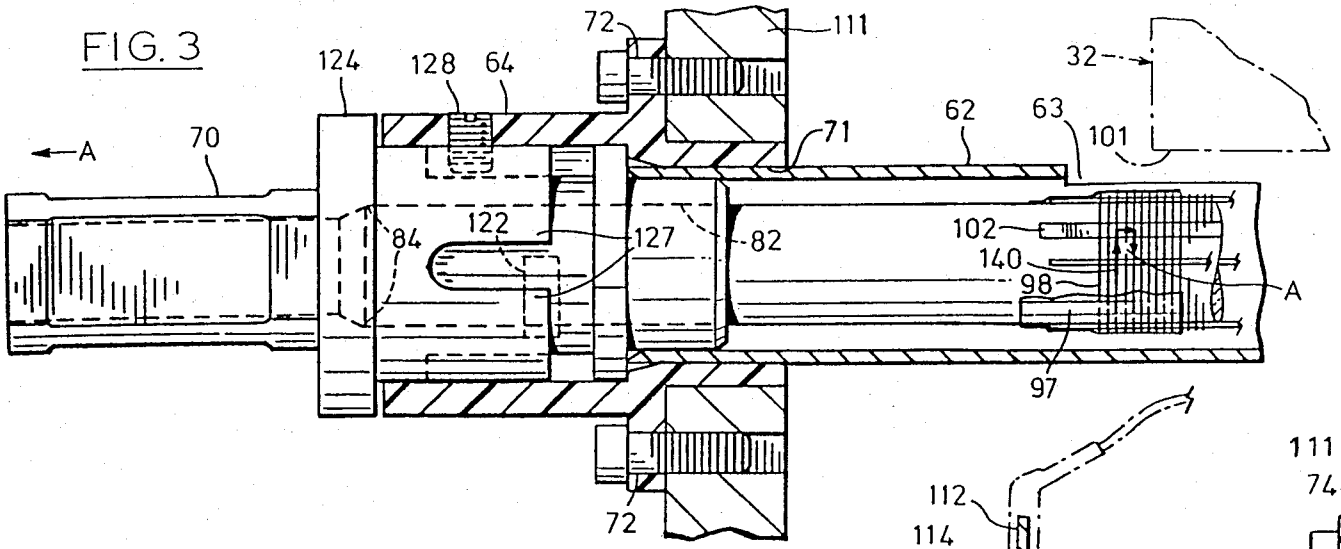
FIG. 3 is a cross-sectional view taken on line 3—3 of FIG. 2 (drawn to a larger scale) and shows the cross-section of the corona device with the handle when assembled in the electrostatic printer.

As seen in FIG. 2, when assembled, the end 65 of the guide tube is located in a recess 61 in the mounting block 66 and is retained in this position by a screw 69. At its other end, and as seen in FIG. 3 the guide tube 62 fits closely within an opening 71 in the block 64 and the inner end of the handle 70 projects into the guide tube to receive end 67 of the glass rod in a central cylindrical recess 82 as far as constriction 84.

The handle 70 is located on the outside of the wall of the electrostatic printer and extends at least partly through the wall.

Figure 4A:
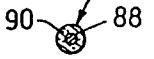
FIG. 4*a* is a cross-section view on line 4*a*—4*a* of the corona electrode.

Referring primarily to FIG. 2 the glass rod 60 has four straight corona electrodes 86 spaced equally around its circumference. Each electrode 86 comprises a tungsten wire 88 (FIG. 4*a*) which is sheathed in a high temperature glass 90 for most of the length of the tungsten wire. The glass is preferably type 1720 (trade mark) sold by Corning Glass.

The wire 88 is 7 thousandths of an inch in diameter and the glass 90 is 1.75 thousandths of an inch thick giving each electrode a diameter of 10.5 thousandths of an inch. Near the end 68 of the glass rod the glass 90 is removed from each tungsten wire 88 to leave bare sections 92 (FIG. 4) which are then secured to the glass rod surface by a high temperature epoxy resin at two locations 94.

Referring now primarily to FIGS. 3 and 4, a conductive biasing member in the form of a continuous wire 98 is wound around the glass rod 60 and over the electrodes for a portion of its length which is greater than the length of that part of the rotatable cylinder 32 (FIG. 1) used for printing. The wire 98 is made of tungsten and is 2 thousandths of an inch in diameter. The wire 98 is wound closely to give 112 wraps to the inch along the rod to provide an effectively continuous conductive biasing member for all of the electrodes. It is important that the wire is wound uniformly to give a constant angle of helix between the wire 98 and the axis of the glass rod 60 over the length of the corona electrode. This provides uniform ion clouds to pass through the longitudinal aperture 63 which results in efficient erasure of charge on the surface of the cylinder. An electrically conductive foil 102 extends parallel to and between two of the electrodes beneath the wound wire 98 and is in contact with this wire at each wrap. The wire is terminated at each end by electrically insulating tapes 97, 99 wound around the glass rod 60.

The conducting foil 102 is preferably made from 301 stainless steel and is 80 thousandths of an inch wide by 1 thousandth of an inch thick. As seen in FIG. 4, the foil 102 has an end portion 104 which is wound around the glass rod so that it lies opposite to a small aperture 106 in the wall of the guide tube 62 for reasons to be explained later.

Reference is now made primarily to FIG. 2 to describe the assembly of the device. Firstly, the glass rod 60 is inserted through the sleeve 76 and the sleeve is then located within the guide tube 62 such that a rectangular aperture 108 in the insert is aligned with an aperture 110 in the wall of the tube 62. The tube, the insert and the glass rod are dimensioned such that when the glass rod is inserted and aligned, one of the bare sections 92 of one of the tungsten wires 88 is viewable through the now aligned apertures 108 and 110. This tungsten wire is contacted through these apertures by an electrical contact 112 housed in a moulded generally C-shaped contact block 114 (FIG. 2) which is shaped to fit snugly on the guide tube 62. This contact provides for connecting the high voltage potential to the electrode 86 and is generally L-shaped and is secured by a high temperature epoxy resin, preferably Eccobond H 281 (trade mark) supplied by Emerson and Cuming, a Division of W. R. Grace and Co. The current path is completed by attaching a stainless steel brush contact 118 which is mounted on the tube 62 at the aperture 106 by two small screws 120. The brush contact 118 is made of wire 2 thousandths of an inch diameter and contacts the wound wire 98 and the end portion 104 of the foil 102 thus completing the corona circuit. Next, the end 67 of the glass rod is passed through the mounting block 64 and into the recess 82 of the handle 70 as previously described.

When the handle is assembled it will be seen that shoulder 124 engages the outer face of the block 64 and that a central portion 125 is contained in the block. This portion defines an annular slot 127 joining four axial slots 126 spaced about the portion 125. These slots provide clearance for a locating screw 128 which retains the handle in the block 64 while permitting it to be rotated between four discrete positions by pulling it out until the screw is in the slot 27, turning it to align the screw with a new one of the slots 126 and pushing it in so that the screw prevents further rotation because it is now received in a slot 126. Evidently, during assembly, the glass rod must be positioned angularly relative to the handle and attached in this position so that on assembly in walls 111 (FIGS. 3 and 4) one electrode 86 is in the desired position and the others can be made to assume the same position by rotating the glass rod using the handle as described. This part of the assembly is of course quite critical. The glass rod is attached to the handle using any suitable high temperature adhesive such as the aforementioned Eccobond H281.

It should also be noted that the longitudinal slots 72 and 74 in mounting blocks 64 and 66 permit the location of the mounting block to be adjusted relative to the cylinder 32 (FIG. 1) such that the corona electrode is located at the optimum distance from the surface of the cylinder. This distance is usually set by a feeler gauge and a typical distance between the electrode and the cylinder surface is 0.020 inch. The mounting block 64 also has a short annular recess 122 which receives a projection of an interlock with the handle on the printing apparatus used to engage and disengage contact between the cartridge 38 and the connector 42. The electrode cannot be changed unless this handle is moved to a disengaged position, and also, if the corona electrode assembly is not in the right position for use, the interlock projection will not engage.

When the electrostatic printer is in use current is supplied via the contact 112 to energize the electrode 86 to a potential of 2000 v peak-to-peak using an a.c. signal of 125 KHz. A cloud of charged ions is produced along the length of the wire with the conductive biasing member 98 and this cloud is delivered to the cylinder surface through the longitudinal aperture 63 due to the potential difference across the gap. The current return is made via the conductive biasing wire 98 and portion 104 of foil 102 which contact the brush contact 118. This foil ensures continuity even if for some reason the wire 98 should develop an electrical discontinuity. The biasing wire 98 and foil 102 are kept at an offset potential of about −5 volts to compensate for leakage of ions through the screen. This leakage can result in offset voltages in the range +20 to −20 volts because the leakage is sensitive to the geometry, to the shape of the alternating wave form, and also to atmospheric conditions. If this atmospheric charge is not cancelled the printed copy can appear smudged or dirty due to toner being attracted to locations where no print is desired.

Any residual field on the dielectric surface is cancelled because a pool of positive and negative ions is created in the spaces between the electrode and the biasing wire. These ions are effectively available to be attracted to charge on the dielectric to cancel the residual charge. No current will flow when the biasing wire is maintained at a voltage equal to the offset voltage and this condition will arise when the voltage on the dielectric is zero. The residual charge is then eliminated.

Should the conductive biasing wire 98 fail for any reason such as a break occurring for example at point A in FIG. 3, then the current path is altered as shown by the arrowed heavy line 140: the current then travels along the conductive biasing wire 98 until the break at point A and is then rerouted via the conductive foil 102 and then back onto the biasing wire 98 thereby providing electrical continuity. The small distance between adjacent wraps of the coil of the biasing wire 98 means that it is seen by the surface of the cylinder as the equivalent of a continuous member and the overall effect of these discrete wraps of the biasing member on the efficiency on erasure is neglible.

It will be appreciated that various changes may be made to the components of the apparatus hereinbefore described without departing from the scope of the invention.

In the geometry of this the preferred embodiment, the coil density was 112 wraps per inch. This was found to be the preferred value although in fact the density could be anywhere between 76–124 wraps per inch for wire of 2 thousandths of an inch (in this geometry). The power amplifier which drives the corona electrodes is a tuned power amplifier but is not highly selective. It operates with a nominal capacitance of 70 pF+20 pF where the nominal capacitance is the equivalent capacitance of the full erase wire and screen as seen by the amplifier. When the coil density is less than 76 wraps per inch the spaces between wraps became excessive and if more than 124 wraps per inch is used, the wire effectively shields the electrode, leading to inefficient erasure.

The conductive biasing wire could be of a different thickness, for example 1 thousandth of an inch, and this has been found suitable with the coil density being modified. In this respect the diameter of the rod could also be changed.

The electrode wire can also be of other materials provided that a good seal is achieved with the glass and that the wire and glass are matched for thermal expansion. Other glasses which have suitable mechanical and electrical properties include types 1723 and 7070 (trade marks) made by Corning Glass.

The conductive biasing member 98 may also be stainless steel, however tungsten is preferred for its strength and high resistance to attack by sputtering and other effects of corona discharge. The foil 102 can also be a tungsten or stainless steel wire of 1 thousandth of an inch diameter, although stainless steel foil is preferred because it provides a superior electrical contact with the wire brush, the other important requirement is that it is non-corroding.

The corona energising signal may be between 1800–2200 v peak-to-peak at a frequency of 75–150 KHz although the region 100–125 KHz is preferred, and the offset potential can vary between +20 and −20 volts, though with the materials and values given in the preferred embodiment −5 volts has been found to be the optimum value.

The brush used to contact the conductive biasing member could be changed. At present the brush comprises a group of densely packed strands of stainless steel wire compressed between two pieces of metal which is then screwed into the side of the tube wall. However any resilient contact such as a high voltage conductive polymer would achieve the same function. In addition, although the L-shaped contact 112 is secured to the C-shaped block 114 by epoxy it could in fact be moulded in place.

Advantages of the invention include ease of manufacture with a minimal amount of components which require no special manufacture. The life of each of the individual electrodes is maximized by compensating for breakage in the biasing electrode. The provisions of four electrodes with a common member maximizes the life of the corona erase device and also reduces the maintenance and replacement requirement in contrast to the existing devices.

We claim:

1. A corona device for use with a dielectric surface to modify electrostatic charge on the surface, the device comprising:

an elongate dielectric support member;

a plurality of straight corona electrodes mounted on the member in spaced relation about the member, each electrode having an electrically conductive core and an electrically insulating sheath;

an electrically conductive biasing member encasing the support member and electrodes on the support member;

means journalling the support member for rotation and angular location at a number of positions equal to at least the number of electrodes;

electrical contact means for connecting the device to an electrical source, the contact means being coupled to the journalling means and establishing continuous electrical connection to the biasing member and to a selected one of the electrodes whereby upon rotating the support member into each of said selected positions electrical connection is made to a different one of the electrodes so that the user can select the electrodes to isolate damaged electrodes until all of the electrodes have been used.

2. A device as claimed in claim 1 in which the electrically conductive biasing member is a wire wound around the support member and electrodes such that there are between 76 and 124 wraps per inch measured along the length of the support member.

3. A device as claimed in claim 1 and further comprising a substantially straight conductive element mounted on the support member between a pair of the electrodes and in electrical contact with the biasing member to provide an alternate electrical path should there be an electrical discontinuity in the biasing member.

4. A device as claimed in claim 2 in which the support member is cylindrical and the biasing member is wrapped using a constant helix angle.

5. A corona device as claimed in claim 1 in which the journalling means includes a guide tube containing the support member and defining an elongate slot aligned with the selected one of the electrodes providing a directional bias to the corona discharge.

6. A device as claimed in claim 1 in which the support member is cylindrical.

7. A device as claimed in claim 6 in which there are four electrodes.

8. A device as claimed in claim 1 in which the support member is a glass rod.

* * * * *